United States Patent [19]

Kaplan et al.

[11] Patent Number: 5,016,518

[45] Date of Patent: May 21, 1991

[54] METHOD AND APPARATUS FOR ACCELERATING PROJECTILES

[75] Inventors: Zvi Kaplan; Gideon Engler, both of Rehovot; Avi Loeb, Jerusalem, all of Israel

[73] Assignee: The State of Israel, Atomic Energy Commission, Soreq Nuclear Research/Center, Israel

[21] Appl. No.: 496,806

[22] Filed: Mar. 21, 1990

Related U.S. Application Data

[63] Continuation of Ser. No. 318,139, Mar. 2, 1989, abandoned.

[30] Foreign Application Priority Data

Mar. 3, 1988 [IL] Israel ..... 85622

[51] Int. Cl.[5] ..... F41B 6/00

[52] U.S. Cl. ..... 89/8; 102/202.5; 102/472

[58] Field of Search ..... 89/8; 102/202.5, 202.6, 102/202.7, 202.8, 202.9, 202.11, 202.12, 202.13, 202.14, 380, 472

[56] References Cited

U.S. PATENT DOCUMENTS

| | | | |
|---|---|---|---|
| 1,349,414 | 8/1920 | Dougan | 102/472 |
| 3,495,349 | 2/1970 | Thompson | 102/472 |
| 3,613,499 | 10/1971 | Hubbard et al. | 89/8 |
| 3,736,839 | 6/1973 | Kaprelian et al. | 102/202.8 |
| 4,640,180 | 2/1987 | Rose | 89/8 |

OTHER PUBLICATIONS

Gun Propulsion Techniques, Progress: Astronautics and Aeronautics, vol. 109, A1AA/1988, Chapter 15, Paul G. Baer et al.

Oerlikon Pocket-Book, Werzkeugmaschinenfabrik Oerlikon-Buhrle AG, 1981.

Charge Design considerations and Their Effect on Pressure Waves in Guns, Ingo. May et al., Ballistic Research Laboratory, 1978.

Formation of a Plasma Focus in a Plasma Erosion Accelerator, N. P. Ozlov et al., Sov. Phys. Tech. Phys., vol. 19, No. 12, Jun. 1975.

Experimental Study of the Plasma Focus in an Erosion Plasma Accerlator, N. P. Kozlov et al., Sov. Phys. Tech. Phys., vol. 18, No. 4, Oct. 1983.

Quasistationary Plasma Flows in Accerlators for Large Stewart Parameters, Yu M. Grishin et al., Sov. Phys. Tech. Phys., vol. 18, No. 11, May 1974.

Similarity Criteria for Shock Waves of Plasmodynamic Discharges from Magneto-Plasma Compressors in Dense Gases, Zhurnal Prikladnoi Mekhaniki i Tekhnicheskoi Fiziki, No. 4, pp. 95-100, 1985.

Kaye, Seymour M., Encyclopedia of Explosives and Related Items, 1978, pp. 307-310, "Plasma".

Sarbacher, Robert I., Encyclopedic Dictionary of Electronics and Nuclear Engineering, 1959, p. 944, "Plasma".

*Primary Examiner*—Stephen C. Bentley

*Attorney, Agent, or Firm*—Steinberg & Raskin

[57] ABSTRACT

A gun for accelerating projectiles in which the travelling chemical charges are ignited by electrothermal energy sources. By one mode there are provided electrothermal energy injectors along the gun barrel which are fired synchronously with the displacement of the projectile within the barrel, each such injector igniting a distinct chemical propellant charge attached to the projectile. Essentially that mode of the gun operates by the travelling charge principle in which the boosting of the thrust on the projectile is brought about by successively ignited propellant charges attached to the projectile itself while the electrothermal energy injectors on the barrel serve for ignition only.

By an alternative mode a plasma injector unit is mounted at the rear of the gun coaxially with the barrel and the injected plasma acts via fluid to initiate the chemical propellant and enhances the chemical propellant burning rate to improve the gun performance.

12 Claims, 2 Drawing Sheets

6a
6
9
3
7
4
8
5
1
2
22a
27a
Trigger
DELAY
10a
24a
10a
12a
13a
25a
16a
17a
17a
14a
16a
20a
HV
18a
27b
Trigger
DELAY
10b
10b
12b
25b
HV
27c
Trigger
DELAY
10c
10c
12c
25c
HV

METHOD AND APPARATUS FOR ACCELERATING PROJECTILES

This is a continuation of application Ser. No. 318,139, filed 3-2-89, now abandoned.

FIELD OF THE INVENTION

This invention relates to a method and apparatus for accelerating projectiles. In particular, it relates to an improved method and apparatus for increasing the acceleration of a projectile to hypersonic velocities.

BACKGROUND OF THE INVENTION

Known methods for accelerating projectiles generally fall into three categories: a first approach is to apply a momentum to the rear of the projectile in order to accelerate it in accordance with Newton's Second Law of Motion. Alternatively, pressure may be applied to the rear of the projectile in order to accelerate the projectile also in accordance with Newton's Second Law of Motion; and, thirdly, a projectile may be accelerated in a similar manner to a rocket in accordance with Newton's Third Law of Motion.

U.S. Pat. No. 2,783,684 (Yoler) describes a method and means for propagating a mass within a tube, by generating a shock wave which is accelerated down the length of the tube in order to impart energy to the mass. The shock wave is created by means of an electric arc generated within the tube via high voltage electrodes. Electrodes are spaced along the length of the tube, so that the electric arcs will continuously be generated as the shock wave travels down the tube, thereby maintaining the pressure behind the solid mass. It is thus clear that Yoler's method is based on applying sufficient pressure to the rear of the mass in order to apply a constant thrusting force in accordance with the second of the three principles recited above.

There is likewise described in U.S. Pat. No. 2,790,354 (Yoler et al.) a mass accelerator employing electrical energy in order to propagate a projectile at high speed within a tube. The principle employed is identical to that of the first Yoler patent cited above, in that the electrical energy is used to create vast quantities of gas which create a shock wave towards the rear of the projectile.

U.S. Pat. No. 4,590,842 (Goldstein et al.) describes a method and apparatus for accelerating a projectile within a tube by generating a high velocity, high pressure plasma jet behind the projectile. Plasma jet streams are continuously generated along the length of the tube in synchronism with the motion of the projectile, by applying a high voltage across a suitable dielectric wall. The resulting plasma jets are directed through nozzles so as to apply momentum and pressure at the rear of the projectile, in accordance with the first two phenomena described above.

Electrical means for accelerating projectiles by utilizing plasma jets are also disclosed in U.S. Pat. No. 4,715,261 (Goldstein et al.), wherein a cartridge containing a plasma source for accelerating a projectile through a gun barrel bore described. The principle is identical to that employed in the first Goldstein patent cited above, in that the plasma jet imparts energy to the cartridge by means of the transfer of pressure.

Instead of using electrical means for accelerating projectiles, it is, of course, well known that chemical propellants can be used effectively to drive projectiles in a conventional gun barrel to speeds not in excess of 2 km $s^{-1}$. This upper limit on the projectile velocity which can be achieved efficiently, results from the inability of the chemcial reaction to continuously supply the necessary increasing gas flow rate which is required for a constant thrust force at the base of the projectile.

This limitation of chemical propellants in conventional guns may be overcome at least to some extent in the travelling charge gun. In such a gun, as well as the conventional initial charge, an additional propellant charge is attached to the rear of the projectile, and is ignited during the acceleration process. Thus, the additional propellant charge constitutes a travelling charge which travels with the projectile until it is completely consumed, the projectile being forwardly propelled by means of the backward thrust of the burning propellant charge, relative to the projectile, which creates a corresponding forward reactive thrust on the projectile. Normally, the projectile is accelerated from rest using conventional initiating means, ignition of the travelling charge only commencing after the projectile has travelled a predetermined distance, and has therefore acquired a minimum initial velocity.

By using this technique, it is possible to obtain higher velocities due to the combined action of both the thermal pressure produced by the hot gaseous products of combustion, and a rocket mechanism which contributes additional thrust to the projectile in accordance with the third of the phenomena described above. It has been shown theoretically that in a travelling charge gun a ballistic situation can be established in which the propellant burning rate constantly increases proportionally to the projectile velocity, so as to maintain a constant pressure in the barrel behind the projectile.

The thermal pressure towards the rear of the projectile decreases significantly only when the velocity of the projectile exceeds approximately two and a half times the speed of sound of the propellant gases. This speed is the relative difference in the velocities of the gaseous products of combustion which accelerate the travelling charge, and the gases which expand from the breech of the gun. Thus, whilst the contribution of thermal pressure to the acceleration process is limited, higher velocities may nevertheless be achieved even when this limitation is reached, by employing a rocket mechanism which can be sustained in the barrel. In principle, therefore, the travelling charge gun provides an efficient method and apparatus for accelerating a projectile in order to achieve high velocities of several kilometers per second, i.e. beyond the limits of conventional guns.

Nevertheless, travelling charge guns have not enjoyed widespread use, mainly owing to the difficulty of obtaining the required burning rates of the propellants, which rates have to be controlled continuously throughout the acceleration of the projectile.

SUMMARY OF THE INVENTION

It is an object of the invention to provide a new and improved method and apparatus for accelerating a projectile.

According to a broad aspect of the invention, there is provided, in a method for accelerating a projectile in a launching tube at a rate determined by the rate of combustion of a propellant charge disposed within the tube at the rear of the projectile, the steps of generating an electrical discharge for producing hot gases, and injecting the hot gases into a region of the launching tube in the rear of said projectile so as to interact with said propellant charge, thereby increasing its rate of combustion.

Generally, the invention can be applied to a launching tube constituted by a conventional gun barrel so as to apply a very high initial thrust to the projectile, thereby to achieve higher starting accelerations than can be obtained using conventional initiation methods, whilst at the same time achieving greater control of the gas pressure within the tube.

In a preferred embodiment of the invention, the projectile is provided with a travelling charge disposed within a suitable gun barrel, the travelling charge comprising chemical propellants which are consumed in stages as the projectile progresses down the gun barrel. The combustion of the travelling charge is in effect similar to the firing of a multi-stage rocket, except that rocket exhaust is exposed to the atmosphere whilst the launching tube containing the projectile is closed at one end so as to provide an additional thrust on the projectile by means of the increased pressure of the trapped gases. In order to effect the ignition of each propellant stage, hot gases at high pressure are introduced into the gun barrel in the region of the travelling charge. This not only ignites the relevant propellant stage but also increases its burning rate to a much higher value than would be achieved with conventional methods of igniting chemical propellant charges.

The invention can be applied to a travelling charge gun in this manner, in respect of a wide range of projectile sizes and can also provide an extended velocity range as compared with that obtainable with conventional propellant means. To achieve such a result, the travelling charge gun contains an initial regular chemical propellant charge in addition to a multi-stage travelling charge attached to the projectile base. It is arranged that the ignition of each subsequent stage of the travelling charge is effected when the pressure within the gun barrel falls below a predetermined threshold. In practice, such ignition is initiated slightly before the previous propellant stage has been completely consumed. In this way, the pressure profile within the gun barrel may be controlled by means of the products of combustion of the travelling charge, which tend to increase the pressure behind the projectile, thereby compensating for the increasing volume in the tube behind the projectile.

The physical characteristics of the propellant, such as grain size, together with its chemical properties, influence the correct burning speed of the propellant and thereby maintain the desired substantially constant pressure within the gun barrel. As the projectile continues to progress along the gun barrel, the pressure falls within the gun barrel towards the rear of the projectile.

In accordance with an aspect of the invention, there are provided injectors along the gun barrel which are initiated in synchronism with the displacement of the projectile in the tube, and thereby to the fall in gas pressure behind the projectile. Preferably, the injectors provide hot gases which create regions of high pressure and temperature within the travelling charge itself, thereby producing an increased propellant burning speed. This process is repeated along the barrel, as required, by generating further hot gas streams by means of an appropriate electrical discharge.

In order to prevent the possibility of the propellant burning process developing into a detonative reaction, each stage of the propellant charge is preferably isolated from an adjacent stage by introducing an inertial buffer layer, which is non-combustible, thereby ensuring that only one stage of the propellant charge is burned with a single injection of gases, in accordance with the invention.

In order to synchronize the gas injection with the displacement of the projectile within the tube, optical fibers or other sensors are located along the gun barrel facing the bore, so as to sense the passage of the projectile within the gun barrel.

BRIEF DESCRIPTION OF THE DRAWINGS

The invention will now be described by way of example and with regard to a method and apparatus for accelerating a projectile with reference to the accompanying drawings in which.

DETAILED DESCRIPTION OF PREFERRED EMBODIMENTS

Figure 1:
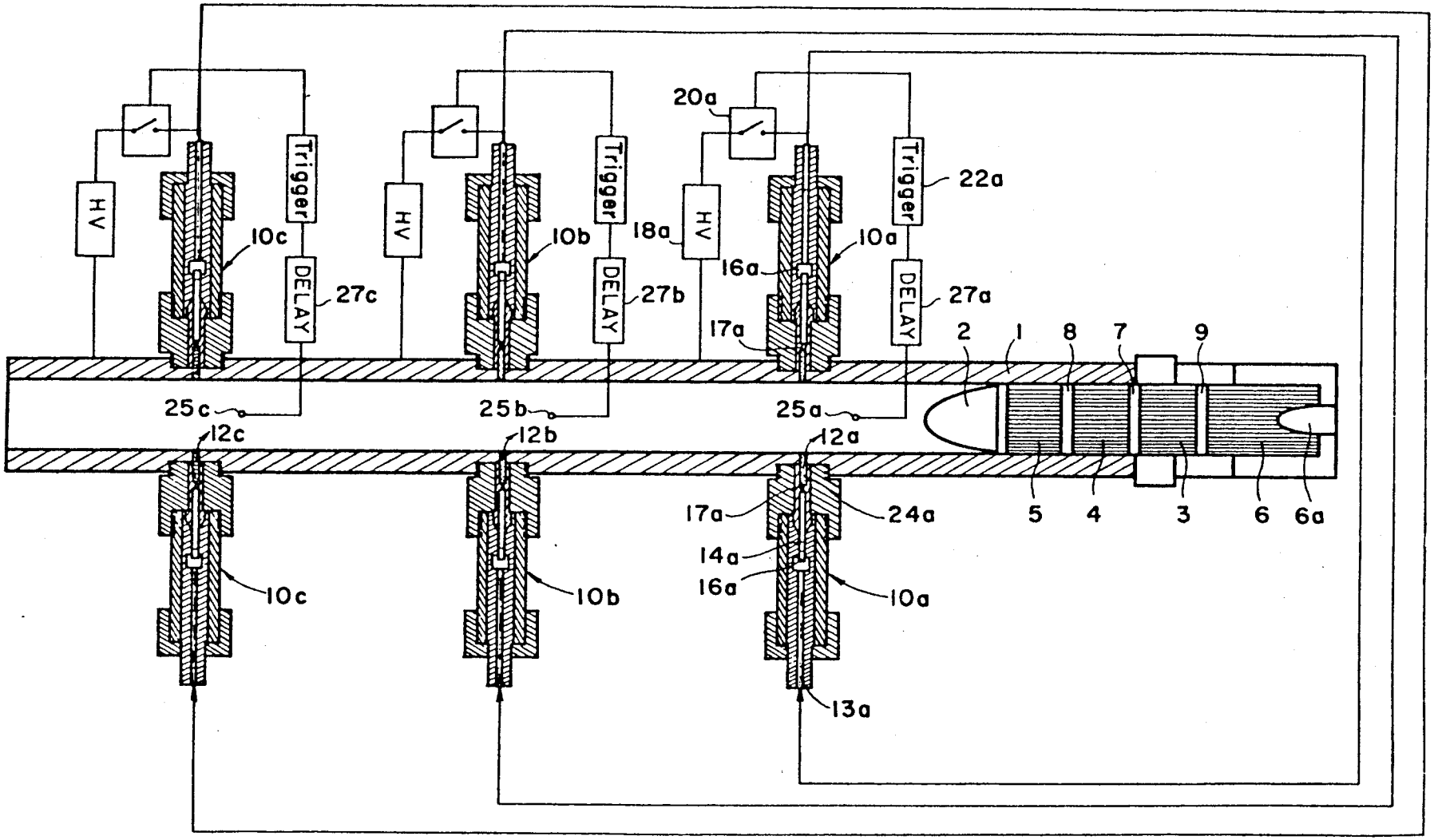
FIG. 1 is a schematic longitudinal sectional view of a travelling charge gun with a projectile having a multi-stage propellant charge, according to a first embodiment of the invention.

Referring to FIG. 1, there is shown a multi-stage travelling charge gun having a launcher tube 1 containing a projectile 2. Attached to the rear of the projectile 2 is a three-stage travelling charge propellant having first, second and third stages 3, 4 and 5 respectively. The three stages are consumed successively, and the first stage 3 is therefore located rearmost.

The launcher tube 1, which is closed at one end, has located therein an initiating charge 6 which is designed to accelerate the projectile 2 to a predetermined velocity. The initiating charge 6 is not attached to the projectile 1 and may be constituted by a chemical propellant which is ignited by a conventional igniter **6*a*** or by injecting hot gases therein so as to cause ignition at an enhanced rate of burning, in accordance with the invention.

Separating the three propellant stages are inertial buffer layers 7 and 8 respectively, which may be constituted by copper, polycarbonate or any other suitable non-combustible material. Likewise, an inertial buffer layer 9 separates the rearmost stage 3 from the initiating charge 6. Each of the three propellant stages 4, 5 and 6 is ignited by a corresponding injector unit **10*a*, 10*b* and 10*c*, respectively, positioned transversely along the tube 1, by means of which high pressure hot gas jets 12*a*, 12*b*, and 12*c* may be injected into the corresponding propellant charge stages. The construction and operation of the hot gas injector units is identical for each of the three propellant charge stages, and will therefore be described in detail with reference to the first injector unit 10*a*** only.

Each injector unit **10*a* comprises a longitudinal tubular portion 13*a* along an inner wall of which is situated an insulating hydrocarbon sleeve 14*a* (such as polyethylene). Disposed across opposite ends of the tubular portion 13*a* are electrodes 16*a* and 17*a* across which is connected a high voltage source 18*a*. The high voltage source 18*a* is adapted to be discharged across the electrodes 16*a* and 17*a* by means of a switching circuit 20*a* which is connected in series with a trigger circuit 22*a*. Towards the end of each injector 10*a* adjacent to the periphery of the tube 1, the electrode 17*a* is flared so as to produce nozzles for directing the flow of high pressure hot gas jets 12***a*. Located within each injector unit 10*a* between the electrode 17*a* and the periphery of the tube 1 is a working fluid 24*a* of water which is to be converted into the high pressure hot gas jets 12*a* when the switching circuit 20*a* is closed.

Thus, although the injector units are similar in principle to those described, for example, in U.S. Pat. No. 4,590,842 referred to above, there is here provided the additional feature that the plasma jets produced by the injector units are passed through a chamber containing a working fluid, thereby lowering the temperature of the plasma jets and avoiding the risk of damage to the launcher tube.

Situated within the tube 1 are sensors 25*a*, 25*b* and 25*c* constituted, for example, by optical fibers or pressure gauges, whose outputs are connected to the trigger circuits 22*a*, 22*b* and 22*c*, respectively, via corresponding delay circuits 27*a*, 27*b* and 27*c*.

The first hot gas jet 12*a*, which is injected into the first stage 3 of the propellant charge, is created by means of the application of a high voltage discharge between electrodes 16*a* and 17*a*. The high voltage discharge causes the hydrocarbon sleeve 14*a* to ablate thereby creating a high pressure plasma jet as described and illustrated, for example, in U.S. Pat. Nos. 4,590,842 and 4,715,261 referred to above. The electrode 16*a* acts as a seal at the end of the tubular portion 13*a* remote from the electrode 17*a*, and thereby prevents the high pressure plasma jet 12*a* from escaping from the injector unit 10*a*. The high pressure plasma jet is thus directed through the working fluid 24*a* which is thereby converted from the liquid state to a hot gaseous state at high pressure. Typically, the working fluid 24*a* is converted to a gas having a temperature of the order of 3000° C. at a pressure of between 1000 and 5000 atmospheres.

The initiating charge 6 propels the projectile 2 from the closed end of the tube 1 to the point in the tube 1 wherein the rearmost propellant stage 3 is aligned with the first injector unit 10*a*. Normally the initiating charge 6 is constituted by a propellant medium such as is employed in conventional guns, for providing high pressure gases which impinge on the rear of the projectile 2. As the projectile 2 progresses further down the closed tube 1, so the volume behind the projectile increases and, consequently, the pressure of the gases produced by the initiating charge 6 will decrease. The position of the first injector unit 10*a* is, therefore, preferably sited at such a position that the initiation of the first propellant stage 3 is optimally timed so as to compensate for the decreasing pressure of the gases produced by the initiation charge 6.

The operation of the system is as follows. The sensors 25*a*, 25*b* and 25*c* constitute synchronizing means which are adapted to produce signals in response to the passage of the projectile 2. The output of the first sensor 25*a* is a suitable electrical signal which is adapted to close the switching circuit 20*a* by means of the trigger circuit 22*a* after a time delay determined by the delay circuit 27*a*. The time delay must be such that the time which elapses from the moment an electrical signal is output by the trigger circuit 18*a* corresponds exactly to the transit time of the projectile 2 in passing from a first position corresponding to its detection by the sensor 25*a*, to a second position corresponding to the rearmost propellant charge 3 being aligned with the injectors 10*a*.

The inertial buffer layers 7, 8 and 9 which separate the three stages of the propellant charge 3, 4, and 5 from each other and from the initiating charge 6, prevent leading stages of the propellant charge from igniting when the high pressure gas jets are injected into corresponding trailing stages, thereby ensuring that the burning process is kept under control and preventing an undesired explosion. Thus, for example, the inertial buffer layer 7 ensures that only the first stage 3 of the multi-stage propellant charge is burned during the first ignition produced by the injector unit 10*a*.

When the first propellant stage 3 is ignited by the first injector unit 10*a*, the projectile 2 is thrust forward by means of both the rocket effect produced by the backward moving gaseous combustion products as well as by the high pressure of the gases which are trapped within the closed tube 1 behind the rear of the projectile 2. The second and third injecting units 10*b* and 10*c*, respectively, are likewise located along the closed tube 1 at suitable intervals for igniting the second and third propellant stages 4 and 5, respectively.

In the described embodiment the synchronizing means are provided by means of sensors adapted to detect the passage of the projectile along the tube so as to activate the respective injector unit at the correct time. However, the synchronizing means may also be pre-programmed so as to activate the sensors at predetermined times in accordance with known criteria such as the quantity of propellant in each stage of the travelling charge, the distance between successive injector units, the propellant rate of consumption, and so on.

In FIG. 1 the features of the invention have been described with particular reference to a travelling charge gun, wherein the projectile thrust arises out of a combination of the rocket effect and high pressure exerted by gases against the rear of the projectile. However, it will be apparent that the invention may be advantageously employed even with projectiles which are propelled by conventional means, e.g. wherein the rocket effect characterising a travelling charge is absent.

Figure 2:
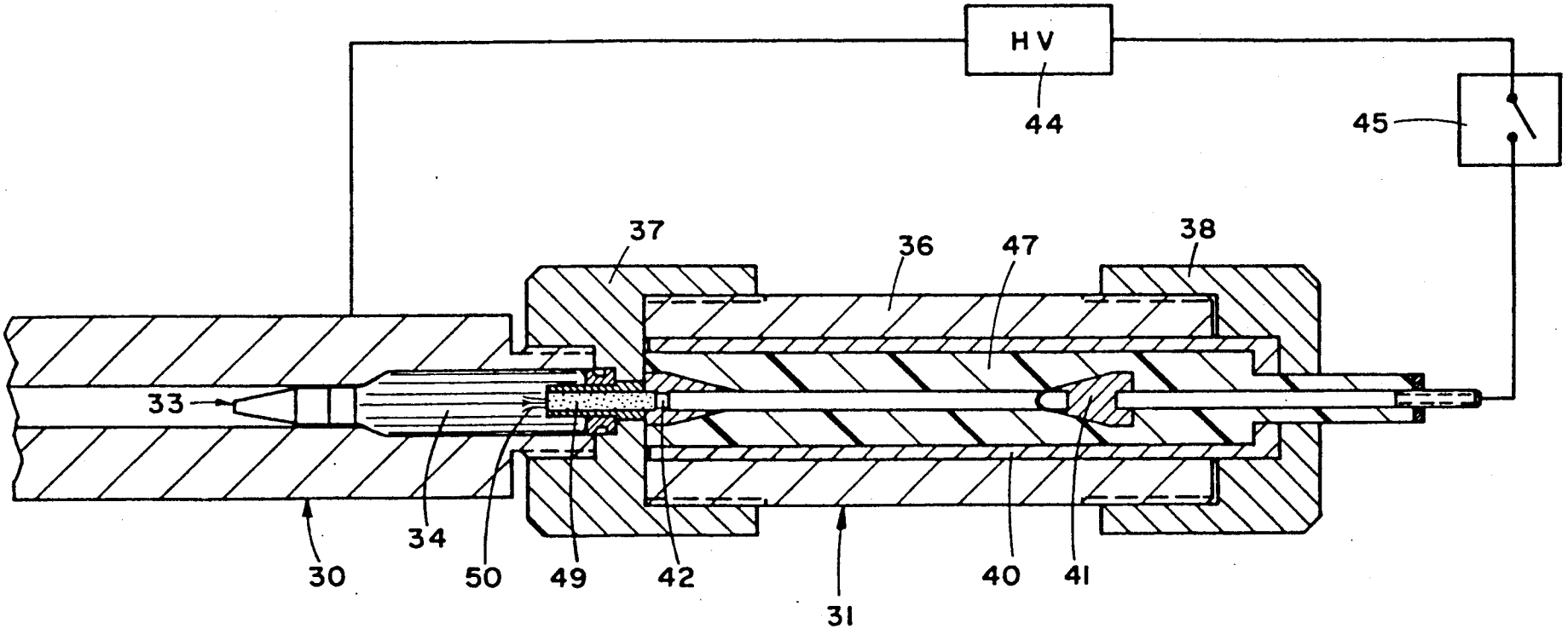
FIG. 2 is a schematic longitudinal sectional view of a conventional gun employing an improved initiating charge in accordance with a second embodiment of the invention.

Referring to FIG. 2 there is shown schematically such an embodiment wherein a conventional breech gun 30 is provided with an initiating charge injector unit 31 in accordance with the invention.

The gun 30 is provided with an ammunition cartridge 33 which includes a conventional chemical propellant 34. The injector unit 31 is fitted to the rear of the gun 30 and comprises a main cylindrical housing 36 to which are threadably coupled two end caps 37 and 38. Located axially within the housing 36 is a plasma injector unit 40, as described above, and comprising electrodes 41 and 42 across which is connected a high voltage source 44 in series with a switching circuit 45. Within an inner core of the plasma injector unit 40 is a polyethylene sleeve 47, towards the front end of which is provided a suitable working fluid 49, such as water.

The operation of the initiating charge injector unit 31 is as follows. When the switching circuit 45 is closed, a high voltage is applied across electrodes 41 and 42 causing the polyethylene sleeve 47 to ablate. This creates a high pressure plasma jet which is directed through the working fluid 49 converting it to a high pressure, high temperature gas jet 50. The hot gas jet 50 interacts with the chemical propellant 34 in the gun 30 causing it to ignite and simultaneously increasing its burning rate.

It has been found that the initial thrust produced by such an initiating unit is sufficiently greater than that derived in conventional guns to render the provision of such a modified initiating unit sufficiently advantageous, even without the cascaded effect of multi-stage propellant combustion provided in the first embodiment.

It will also be understood that whilst in the preferred embodiments, the injector units are based on the provision of a high pressure gas jet using water as the working fluid, more generally other working fluids such as alcohol or hydrocarbons may be used with similar effect.

Whilst in the preferred embodiment, the injector unit 31 is external to the ammunition cartridge 33, it will be understood that it can also be located within the ammunition cartridge 33.

Additionally, although the invention has been described with particular reference to the injection into the propellant charge of hot gases derived through the interaction of a plasma jet with a working fluid medium, it will be understood that the hot gases may be constituted by the plasma jet itself, as is known in the art.

We claim:

1. In a method for accelerating within a launching tube a projectile driven by the combustion of a multi-stage granular chemical propellant charge disposed within the tube at the rear of the projectile, the steps of:

generating an electrical discharge externally of the tube of a magnitude such as to produce a plasma jet or hot gas, and injecting the thus produced hot gas plasma jet or hot gas into the tube at each stage of the multi-stage propellant charge located in the tube, thus igniting said granular chemical propellant charge at each said stage thereof and increasing the rate of combustion of each said granular chemical propellant charge at each said stage thereof beyond that obtainable by ignition without injected plasma jet hot gas, thus producing increased thrust on the projectile as a result of the increased rate of combustion proportionally to the projectile velocity and increased rate of trapped gases at the rear of the projectile, thereby increasing the speed of the projectile as it passes through the launching tube.

2. A travelling charge gun for accelerating a projectile, comprising:

a launching tube containing a projectile and a multi-stage granular chemical propellant charge, electrical discharge means located externally of said tube for generating an electrical discharge of a magnitude sufficient to produce a plasma jet of hot gas, at least one injector means for injecting the produced plasma jet or hot gas into the tube at each stage of the multi-stage propellant charge to ignite the charge at each such stage thereof and increase its rate of combustion at each stage beyond that obtainable by ignition without injected plasma jet or hot gas, and synchronizing means for synchronizing each injection of plasma jet or hot gas at each stage of the multi-stage granular chemical propellant charge as the projectile passes through the tube.

3. A gun according to claim 2 wherein said synchronizing means is preprogrammed to activate each injector unit at a predetermined time.

4. A gun according to claim 2 wherein said synchronizing means includes a detector element located within said tube behind a respective one of said injectors, which generates a signal in response to the passage of said projectile.

5. A gun according to claim 4 and further comprising at least one delay circuit responsive to said signal and coupled to a respective injector, for activating said injector after a predetermined time, corresponding to the time taken from said projectile activating said detector to the rearmost stage of said propellant charge reaching said respective injector.

6. A gun according to claim 4 wherein the detector element includes a fiber-optic link.

7. A gun according to claim 4 wherein the detector element includes a pressure gauge.

8. A gun according to claim 2 wherein each said injector means includes means responsive to the electrical discharge means for injecting a high pressure plasma jet.

9. A gun according to claim 8, wherein each said injector means further includes a working fluid which is heated by a respective one of the plasma jets or hot gas, thereby converting the working fluid to hot gases.

10. A projectile for launching in a gun according to claim 2 and provided with a travelling charge propellant each stage of which is isolated from an adjacent said stage by means of an inertial non-combustible buffer layer.

11. A projectile according to claim 10 wherein the buffer layer is made of copper.

12. A projectile according to claim 10 wherein the buffer layer is made of a polycarbonate material.

* * * * *